US008720007B2

(12) United States Patent
Krajenke et al.

(10) Patent No.: US 8,720,007 B2
(45) **Date of Patent: *May 13, 2014**

(54) ADJUSTABLE DECK LID HINGE

(75) Inventors: Gary W. Krajenke, Warren, MI (US); Richard J. Lange, Troy, MI (US); Anthony J. Radman, Macomb Township, MI (US); Thomas F. Bowles, Grosse Pointe Farms, MI (US); Alvin N. Standard, Clarkston, MI (US); Todd A. Granger, Rochester Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 983 days.

This patent is subject to a terminal disclaimer.

(21) Appl. No.: 12/500,989

(22) Filed: Jul. 10, 2009

(65) Prior Publication Data

US 2009/0271947 A1 Nov. 5, 2009

Related U.S. Application Data

(63) Continuation of application No. 11/534,237, filed on Sep. 22, 2006, now Pat. No. 7,594,301.

(51) Int. Cl.
*E05D 7/04* (2006.01)

(52) U.S. Cl.
USPC ..... 16/240

(58) Field of Classification Search
USPC ..... 16/240, 235, 245, 246, 357, 361; 411/389, 413; 296/76, 146.11
See application file for complete search history.

(56) References Cited

U.S. PATENT DOCUMENTS

| | | | | |
|---|---|---|---|---|
| 3,943,818 | A | 3/1976 | Pryor et al. | |
| 4,304,503 | A | 12/1981 | Gehring et al. | |
| 4,893,863 | A | 1/1990 | Skonieczny et al. | |
| 5,074,609 | A | 12/1991 | Dear | |
| 5,328,311 | A * | 7/1994 | Knohl | 411/353 |
| 5,365,639 | A | 11/1994 | Lewkoski | |
| 5,557,829 | A | 9/1996 | Schoen et al. | |
| 5,967,586 | A | 10/1999 | Duffy et al. | |
| 6,030,127 | A * | 2/2000 | Kang | 411/353 |
| 7,037,059 | B2 | 5/2006 | Dicke | |
| 7,347,189 | B2 * | 3/2008 | Anello et al. | 411/353 |
| 2006/0279105 | A1 | 12/2006 | Renke et al. | |

FOREIGN PATENT DOCUMENTS

DE 102005042190 A1 3/2007

* cited by examiner

*Primary Examiner* — Jeffrey O Brien

(57) ABSTRACT

An adjustable hinge assembly for a vehicle deck lid includes an adjustment pin received in a hinge pin that is adjustable to cause the deck lid to become flush with adjacent vehicle body structure. The adjustment pin includes a tool engagement feature that allows for adjustment of the hinge assembly from within the trunk. A second tool engagement feature allows for adjustment of the hinge from outside of the trunk.

12 Claims, 5 Drawing Sheets

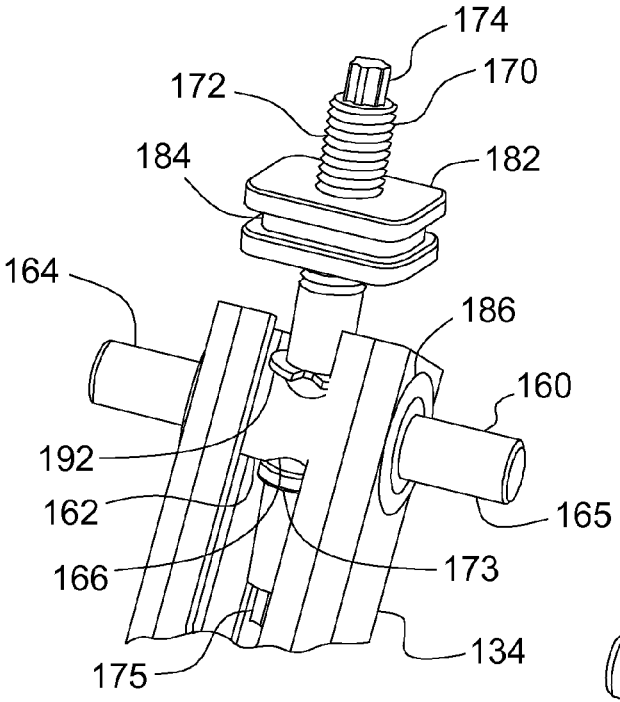
Fig. 10
Fig. 12
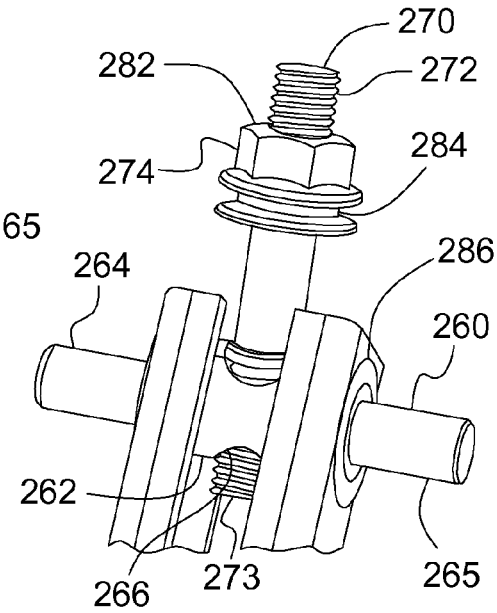
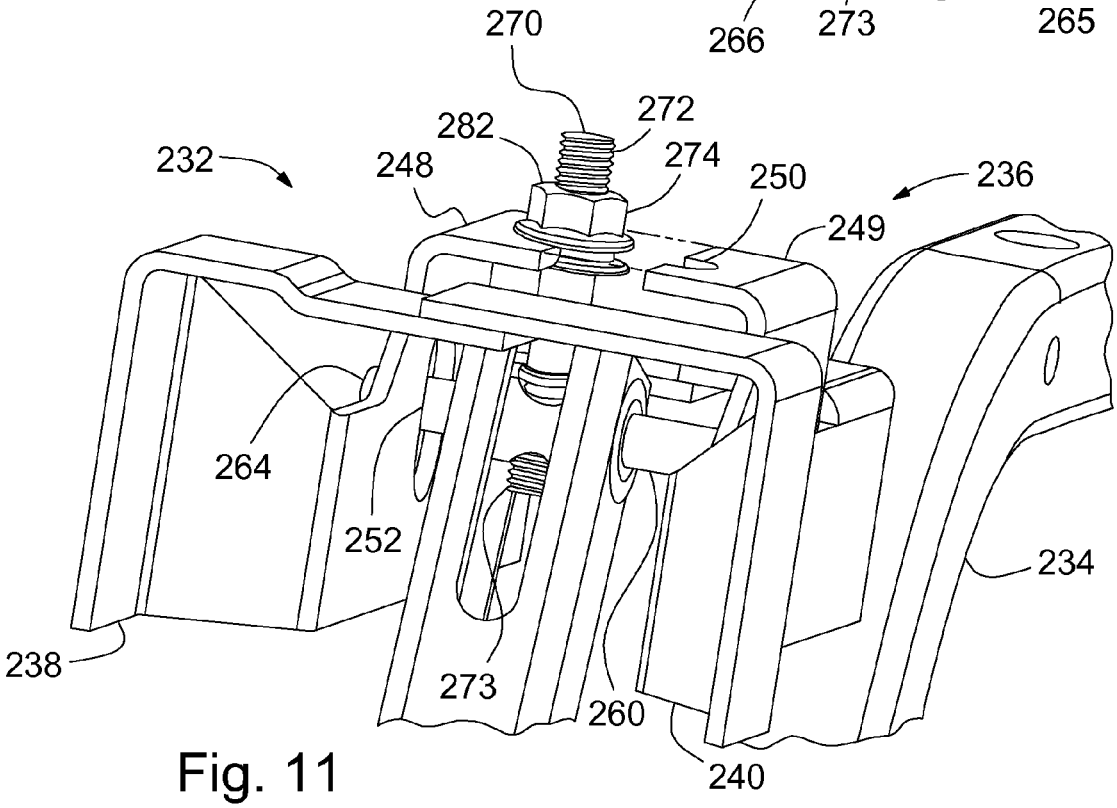
Fig. 11

ADJUSTABLE DECK LID HINGE

CROSS REFERENCE TO RELATED APPLICATIONS

This application claims the benefit of U.S. nonprovisional patent application Ser. No. 11/534,237, filed Sep. 22, 2006, which is incorporated herein by reference.

BACKGROUND OF THE INVENTION

The present application relates generally to an adjustable hinge assembly, and in particular to an adjustable hinge assembly that can be used with a vehicle deck lid or other vehicle closure.

Typically, in automotive vehicles, the various closures are mounted with hinges that may be adjustable in order to assure that the closures are maintained flush with adjacent body structure when in their closed positions. For example, a pair of adjustable hinges is commonly provided to support a rear deck lid of a sedan body style of an automotive vehicle. Such adjustable hinges are typically mounted to vehicle body structure below the rear window, adjacent to a trunk opening, and include hinge straps that are attached to the deck lid and pivot relative to the body structure. Since it is desirable to have the deck lid flush with the surfaces of the adjacent quarter panels when in the closed position, different types of adjustment mechanisms have been employed in the hinge assemblies to allow for adjustment of the deck lid relative to the vehicle body structure.

The adjustable hinge assemblies for these various deck lid hinges, however, have drawbacks that make them less than ideal. For example, the hinge adjustment mechanism may be easily accessible only in a vehicle assembly plant prior to installation of a rear window. Adjustment of the flushness of the deck lid at a later time, should the need arise, is particularly difficult with these types of adjustable hinge assemblies. Some adjustable hinge assemblies may be more costly or complex than is desired. Some of these conventional adjustable hinges may provide adjustment in a direction that is significantly different from normal to the surface of the deck lid, which may complicate the deck lid flushness adjustment process or limit the type of attachment of the hinges to the body structure. And, some adjustable hinge assemblies may require more time and effort on the part of an assembly worker to adjust the hinges than is desirable.

Thus, it is desirable to provide a hinge assembly for use in vehicle closures that allows for easy and accurate adjustment of the flushness of the closure relative to adjacent body panels, preferably both during and after assembly of the vehicle.

SUMMARY OF THE INVENTION

An embodiment contemplates a hinge assembly for use with a vehicle deck lid to allow the vehicle deck lid to move between an open position and a closed position relative to a vehicle trunk opening and adjust a flushness of the deck lid relative to an adjacent body structure. The hinge assembly may include a hinge box, a hinge pin and an adjustment pin. The hinge box is mountable to vehicle structure adjacent to the vehicle trunk opening and has a first side defining a first adjustment slot extending in a longitudinal direction and a second side, spaced from the first side, defining a second adjustment slot extending in the longitudinal direction, and an adjustment pin support. The hinge pin has a body defining a central bore extending therethrough, a first shaft end extending from the body through the first adjustment slot and an opposed second shaft end extending from the body through the second adjustment slot, with the first and second shaft ends axially slidable in the longitudinal direction in the respective first and second adjustment slots. The adjustment pin extends through the central bore and axially supports the hinge pin, with the adjustment pin including first adjustment threads that threadably engage and are rotatable relative to the adjustment pin support and support the adjustment pin relative to the hinge box, and with the adjustment pin having a first end adjacent to the adjustment pin support and an opposed second end adjacent to the central bore of the hinge pin, the second end including a tool engagement feature that is configured to be engageable by a tool from within a trunk to cause the adjustment pin to rotate relative to the central bore and threadably rotate relative to the adjustment pin support.

An embodiment contemplates a hinge assembly for use with a vehicle deck lid to allow the vehicle deck lid to move between an open position and a closed position relative to a vehicle trunk opening and adjust a flushness of the deck lid relative to an adjacent body structure. The hinge assembly comprises a hinge box, a hinge pin and an adjustment pin. The hinge box is mountable to vehicle structure adjacent to the vehicle trunk opening and has a first side defining a first adjustment slot extending in a longitudinal direction and a second side, spaced from the first side, defining a second adjustment slot extending in the longitudinal direction, and an adjustment pin support including a threaded bore therethrough. The hinge pin has a body defining a central bore extending therethrough, a first shaft end extending from the body through the first adjustment slot and an opposed second shaft end extending from the body through the second adjustment slot, with the first and second shaft ends axially slidable in the longitudinal direction in the respective first and second adjustment slots. The adjustment pin extends through the central bore and axially supports the hinge pin, with the adjustment pin having a first end adjacent to the adjustment pin support and an opposed second end adjacent to the central bore of the hinge pin, and with the adjustment pin including first adjustment threads adjacent to the first end that threadably engage and are rotatable relative to the threaded bore and a first tool engagement feature adjacent to the first end that is configured to be engageable by a tool from outside a trunk to cause the adjustment pin to rotate relative to the central bore and threadably rotate relative to the threaded bore, and with the adjustment pin including a second tool engagement feature adjacent to the second end that is configured to be engageable by a tool from within the trunk to cause the adjustment pin to rotate relative to the central bore and threadably rotate relative to the threaded bore.

An advantage of an embodiment is that the hinge assembly allows for adjustment of the deck lid height after assembly of the rear window into the vehicle. Thus, when needed, adjustments can be made to the height of the deck lid relative to the vehicle rear quarter panels relatively easily, even after assembly of the vehicle has been completed.

An advantage of an embodiment is that a retained nut positively engages a hinge box, which allows for positive adjustment both up and down, without relying on gravity, and without requiring that the nut be welded to the hinge box.

BRIEF DESCRIPTION OF THE DRAWINGS

FIG. 10 is a view, on an enlarged scale, similar to FIG. 9, but not showing hinge box brackets.

FIG. 11 is a view similar to FIG. 9, but illustrating a third embodiment.

FIG. 12 is a view similar to FIG. 10, but illustrating the third embodiment.

DETAILED DESCRIPTION

Figure 1:
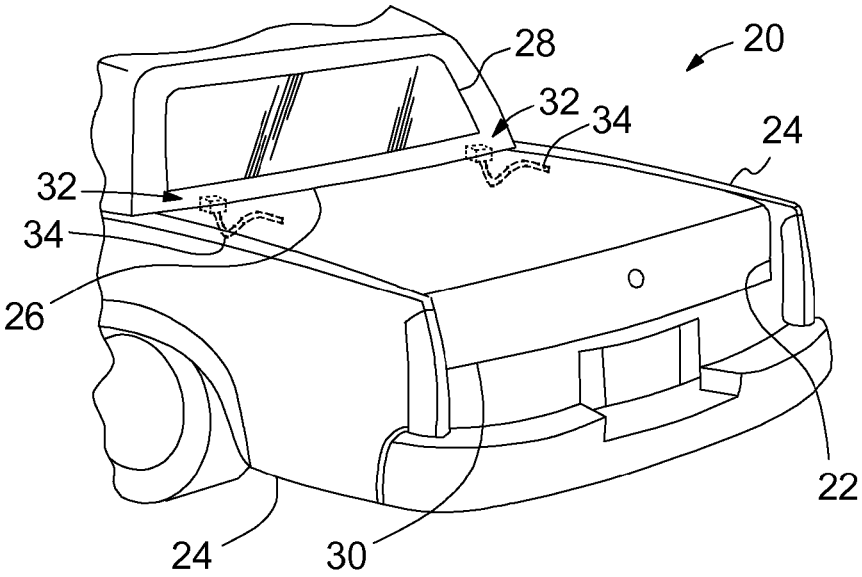
FIG. 1 is a schematic perspective view of a rear portion of a vehicle.
Figure 2:
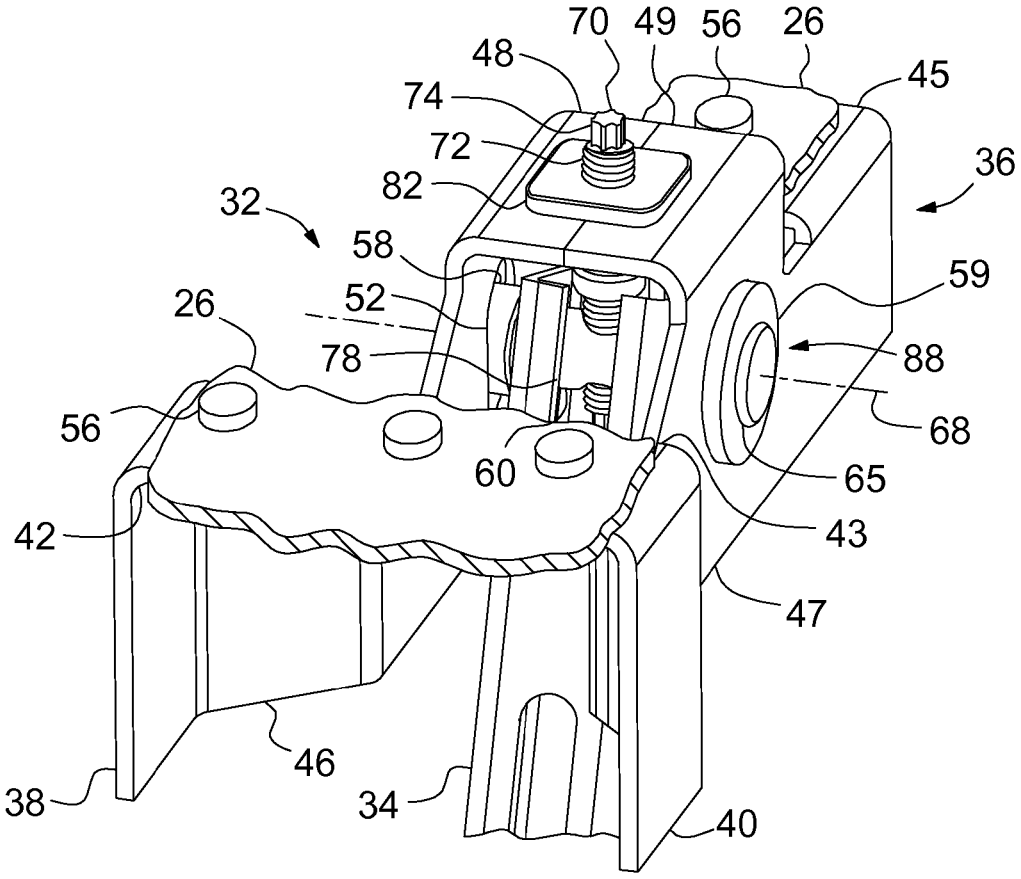
FIG. 2 is a partially schematic, perspective view of a hinge assembly, mounted to vehicle body structure, according to a first embodiment.
Figure 3:
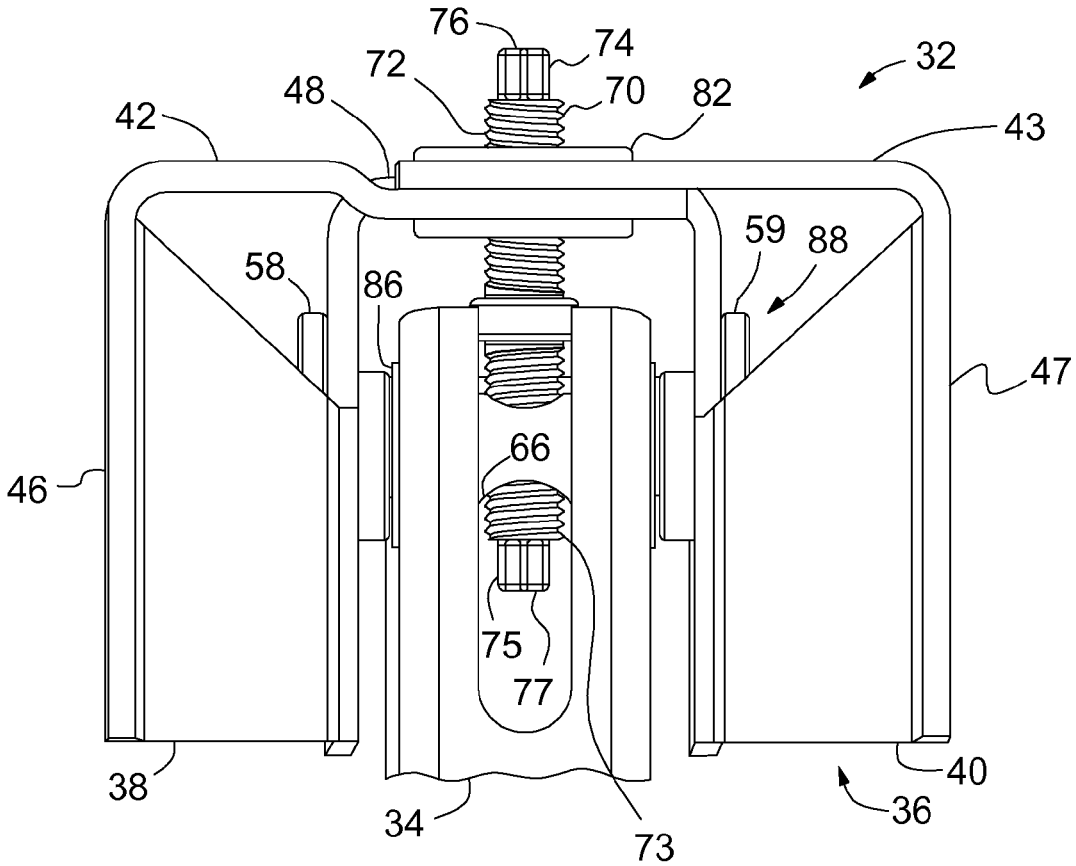
FIG. 3 is a front elevation view of the hinge assembly of FIG. 2.
Figure 4:
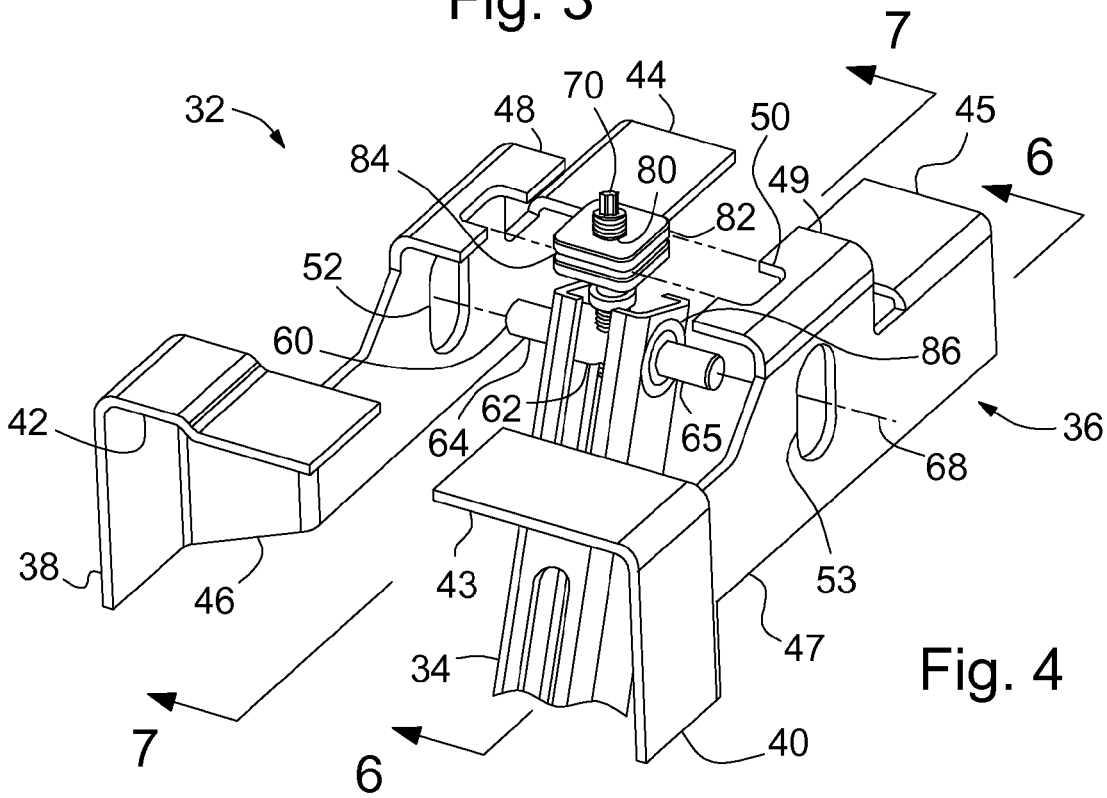
FIG. 4 is a partially exploded perspective view of a portion of the hinge assembly of FIG. 2, prior to completing assembly of the hinge assembly and prior to creating mounting holes in a hinge box.

FIG. 1 schematically illustrates a rear portion of a vehicle 20 having a trunk opening 22 defined partially by a pair of rear quarter panels 24 and laterally extending vehicle body structure 26 located adjacent to a rear window 28 of the vehicle 20. A deck lid 30, in its closed position, covers and seals the trunk opening 22. A pair of hinge assemblies 32 mount to the body structure 26 and each includes a hinge strap 34 that is secured to the deck lid 30 and can pivot relative to the body structure 26. The hinge assemblies 32 are adjustable to allow the hinge straps 34 to be raised and lowered relative to the body structure 26 in order to assure that the deck lid 30 can be made flush with the rear quarter panels 24.

FIGS. 2-8B illustrate the various aspects of a first embodiment of one of the hinge assemblies 32. Since each of the hinge assemblies 32 can be essentially the same as the other, only one hinge assembly 32 will be discussed and shown in detail herein.

The hinge assembly 32 includes a hinge box 36, which has a first hinge box bracket 38 and a second hinge box bracket 40. Each hinge box bracket 38, 40 includes a front mounting flange 42, 43, respectively, which partially overlap, and a rear mounting flange 44, 45, respectively, which overlap. Each hinge box bracket 38, 40 also includes a vertically extending side 46, 47, respectively, that extends between the front mounting flanges 42, 43 and the rear mounting flanges 44, 45, respectively. Hinge support flanges 48, 49 extend from the sides 46, 47, respectively, and meet to form an adjustment pin opening 50. The adjustment pin opening 50 aligns with an adjustment access hole 51 in the body structure 26 (shown in FIGS. 6 and 7). Each of the sides 46, 47 includes an adjustment slot 52, 53, respectively, located adjacent to the adjustment pin opening 50.

Figure 5:
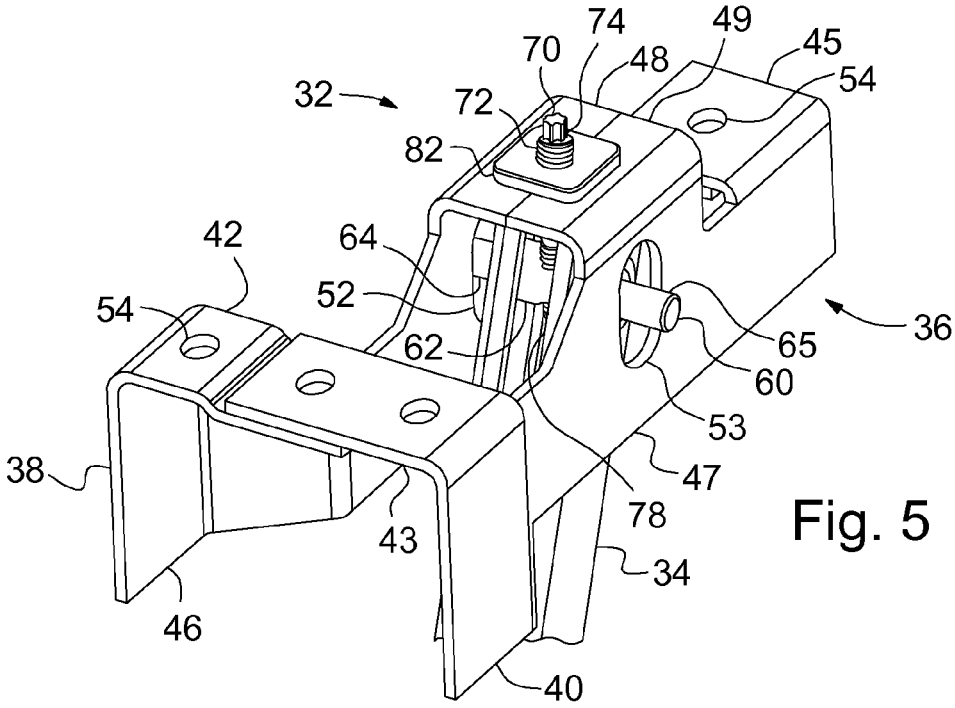
FIG. 5 is a view similar to FIG. 4, but illustrating the hinge box after the hinge box brackets are assembled together and mounting holes are created.
Figure 6:
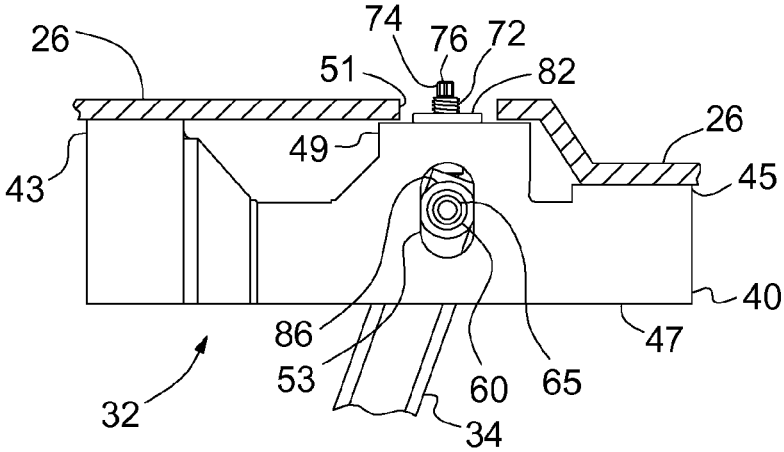
FIG. 6 is a side elevation view of a portion of the hinge assembly as viewed along line 6-6 in FIG. 4, with a hinge strap in a deck lid closed position, plus a schematic illustration of mating vehicle body structure.

The hinge box 36 may include mounting holes 54 extending through the front mounting flanges 42, 43 and the rear mounting flanges 44, 45 (shown in FIG. 5). Fasteners 56, such as bolts with nuts, may extend through the mounting holes 54 and through corresponding holes in the body structure 26 in order to secure the hinge assembly 32 to this structure 26 (shown in FIG. 2). The holes in the body structure 26 and hinge box 36 may be precisely located and sized to assure proper fore-aft and side-to-side locating of the deck lid 30 as assembled (i.e., net holes). Or, alternatively, the mounting holes in the body structure 26 may be slightly oversized in order to allow for some fore-aft and some side-to-side adjustment of the deck lid 30 as it is being installed onto the vehicle 20 before tightening the nuts and bolts. Or, alternatively, the mounting holes may be eliminated, and the hinge boxes 36 welded or otherwise secured to the body structure 26.

The hinge assembly also includes a hinge pin 60. The hinge pin 60 has a cylindrical body 62 with a first cylindrical shaft end 64 extending from the body 62 and a second cylindrical shaft end 65 extending from an opposed side of the body 62—the body 62 and shaft ends 64, 65 defining a pivot axis 68. The first shaft end 64 extends through adjustment slot 52 in the first hinge box bracket 38 and the second shaft end 65 extends through adjustment slot 53 in the second hinge box bracket 40.

A first sleeve 58 is mounted on and can rotate relative to the first shaft end 64 and a second sleeve 59 is mounted on and can rotate relative to the second shaft end 65 (shown in FIGS. 2, 3, 8A and 8B). The first and second shaft ends 64, 65 are upset (also shown in FIGS. 2, 3, 8A and 8B) in order to retain the sleeves 58, 59 on their respective shaft ends 64, 65. Each sleeve 58, 59 includes a smaller diameter portion that fits within and can slide up and down in its adjustment slot 52, 53, respectively, of the hinge box 36, and a larger diameter portion that abuts the vertical sides 46, 47, respectively. The sleeves 58, 59, then, retain the hinge pin 60 in the hinge box 36 and limit its axial movement to sliding along the length of the adjustment slots 52, 53.

The hinge pin 60 also includes a central bore 66 extending through the body 62 substantially perpendicular to the pivot axis 68. The central bore 66 is threaded for mating engagement with an adjustment pin 70.

The adjustment pin 70 has opposed ends with first adjustment threads 72 and an adjacent first tool engagement feature 74 on a first end 76, and second adjustment threads 73 and an adjacent second tool engagement feature 75 on a second end 77. The first and second tool engagement features 74, 75 may be internal or external features that allow a wrench, screwdriver or other tool to grip the particular feature and rotate the adjustment pin 70. The first and second adjustment threads 72, 73 are opposite-handed. That is, if one is right-hand threaded, then the other is left-hand threaded (as viewed from the same end of the adjustment pin 70). The second adjustment threads 73 engage with the threaded central bore 66 in the hinge pin 60, while the first adjustment threads 72 engage with a threaded bore 80 in a retained square nut 82. An access slot 78 in the hinge strap 34 allows the second tool engagement feature 75 to be more accessible when the hinge strap 34 is in a deck lid open position (shown in FIG. 7).

The retained square nut 82 includes a groove 84 that is secured both axially and rotationally within the adjustment pin opening 50. The nut 82 can have a shape other than square so long as the groove 84 is shaped to be restrained axially and rotationally relative to the hinge support flanges 48, 49 of the hinge box 36. In fact, if so desired, one may employ a nut secured to the hinge support flanges 48, 49 (welded or clinched), or may create an integral nut-type feature in the hinge support flanges 48, 49 themselves, so long as threaded adjustment pin support is provided. These alternatives, however, may make fabrication or assembly somewhat more difficult.

The adjustment pin 70, then, supports the hinge pin 60 relative to the hinge box 36 and determines the axial location of the hinge pin 60 within the adjustment slots 52, 53, with the orientation of the adjustment slots 52, 53 defining the direction of adjustability of the hinge pin 60. The hinge strap 34 includes a pair of bushings 86 that each mount around a respective one of the shaft ends 64, 65, completing a pivot joint 88 about which the hinge strap 34 can rotate. Since the hinge strap 34 moves up and down with the hinge pin 60 and is mounted to the deck lid 30 (shown in FIG. 1), the position of the hinge pin 60 within the slots 52, 53 ultimately determines the height, and hence the flushness, of the deck lid 30 relative to the rear quarter panels 24.

An assembly process for the hinge assembly 32 will now be discussed with respect to FIGS. 1-7. The hinge pin 60 is assembled into the hinge strap 34 and bushings 86 are installed. The adjustment pin 70 is threaded into the hinge pin 60 and the grooved nut 82 is threaded onto the adjustment pin 70. The first and second hinge box brackets 38, 40 are brought together, with the hinge support flanges 48, 49 engaging the nut 82 and the first and second shaft ends 64, 65 extending through the adjustment slots 52, 53, respectively. First and second sleeves 58, 59 are inserted onto the corresponding first and second cylindrical shaft ends 64, 65 until they abut the vertical sides 46, 47 of the hinge box 36. The first and second shaft ends 64, 65 are upset, thus securing the components of the pivot joint 88 together. The mounting holes 54 may be formed in the front mounting flanges 42, 43 and rear mounting flanges 44, 45. The fasteners 56 may be inserted through the mounting holes 54 in order to secure the hinge assembly 32 to the vehicle body structure 26. The height of the deck lid 30 is now adjustable relative to the rear quarter panels 24 by rotating the adjustment pins 70 in the hinge assemblies 32.

Figure 8A:
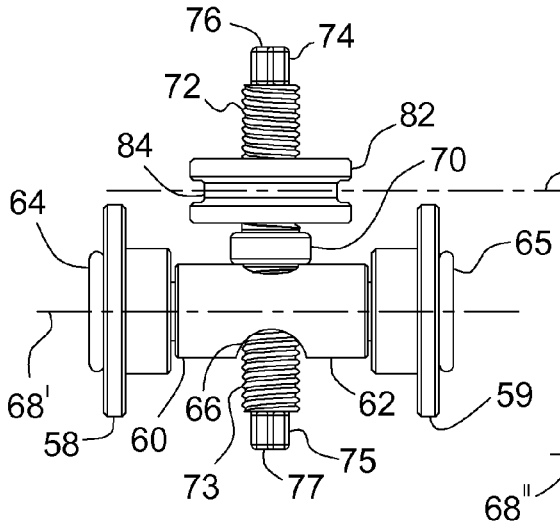
FIGS. 8A and 8B are front elevation views of a portion of the hinge assembly, illustrating full up and full down positions for a hinge pin.
Figure 8B:
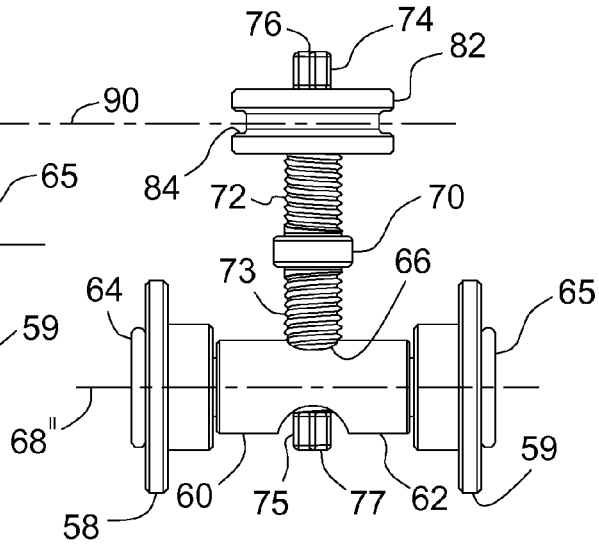

FIGS. 8A and 8B only show a portion of the hinge assembly 32 for the purpose of discussing the process by which the deck lid 30 of FIG. 1 is raised and lowered. The center line 90 extending between FIGS. 8A and 8B indicates a location that is fixed relative to the vehicle body. During initial assembly of the hinge assembly 32, the hinge pin 60 and nut 82 may be threaded about midway onto their corresponding adjustment threads 72, 73 (similar to that shown in FIGS. 2 and 3). In the vehicle assembly plant, if the deck lid 30 is too low relative to the rear quarter panels 24 when initially installed, then an assembly line worker may use a tool (not shown) to reach through the empty rear window opening, engage the first tool engagement feature 74 and rotate the adjustment pin 70 to draw the hinge pin 60 and nut 82 closer together. FIG. 8A shows the hinge pin 60 and nut 82 drawn to each other, with a raised pivot axis 68'. If, in the assembly plant, the deck lid 30 is too high relative to the rear quarter panels 24, then the worker may rotate the adjustment pin 70 in the opposite direction to push the hinge pin 60 away from the nut 82, as seen in FIG. 8B, with lowered pivot axis 68". Once the deck lid height is satisfactory, the rear window of the vehicle may be installed.

Figure 7:
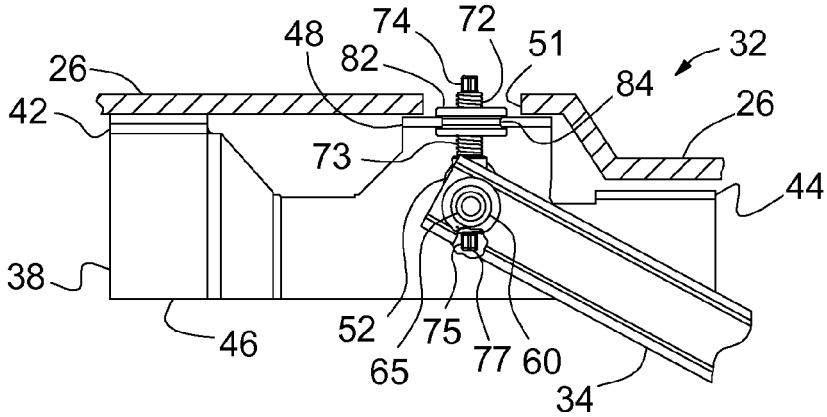
FIG. 7 is a side elevation view of a portion of the hinge assembly as viewed along line 7-7 in FIG. 4, with the hinge strap in a deck lid open position, plus a schematic illustration of mating vehicle body structure.

FIGS. 1 and 7 will be discussed relative to deck lid height adjustment—post vehicle assembly. If, after the vehicle 20 is assembled (including installation of the rear window 28), the height of the deck lid 30 needs to be adjusted, then the second tool engagement feature 75 allows the adjustment to be accomplished relatively easily. The deck lid 30 is opened, allowing one access inside of the trunk 22. FIG. 7 shows the position of the hinge strap 34 when the deck lid 30 is opened. In this hinge strap position, one may insert the tool through the access slot 78 (shown in FIGS. 2 and 5) and engage the second tool engagement feature 75. Rotation in a first direction will raise the deck lid 30 and rotation in the opposite direction will lower the deck lid 30.

One will note that, whether the adjustment is accomplished by engaging the first tool engagement feature 74 or the second tool engagement feature 75, as the adjustment pin 70 is rotated it raises or lowers the hinge pin 60 twice as fast (for a given thread pitch) as a bolt with a single set of threads. That is, when rotated in a first direction, the square nut 82 and hinge pin 60 are simultaneously drawn toward the center of the adjustment pin 70. When rotated in the opposite direction, the square nut 82 and hinge pin 60 are simultaneously drawn toward the ends 76, 77, respectively, of the adjustment pin 70. The oppositely oriented threads for the first and second adjustment threads 73, 73 allow for this. This may allow for a more rapid adjustment of the deck lid height.

One more feature that is preferably included (as illustrated in FIGS. 1-8B) is that the orientation of the longitudinal direction of the adjustment slots 52, 53 is substantially perpendicular to the generally horizontal surface of the deck lid 30. The orientation of the adjustment slots 52, 53 determines the axial direction of movement of the pivot axis 68, and hence the direction of movement of the deck lid 30. This orientation of the adjustment slots 52, 53 allows for the up/down flushness adjustment with very minimal fore-aft motion of the front edge of the deck lid 30 relative to the body structure near the vehicle rear window 28. This, in turn, allows for the use of net sized mounting holes in the body structure 26 (if so desired) rather than the oversized holes employed to mount some prior art hinge boxes to vehicle body structure. This may also allow for welding (or other types of attachment) of the hinge box 36 to the vehicle body structure 26 where lateral or fore-aft adjustment is not possible after installation. Any movement of the deck lid 30 near the trunk latch (not shown) that occurs due to the flushness adjustment can be easily accounted for during installation of or adjustment to the trunk latch or striker (not shown).

As an alternative, the adjustment slots 52, 53 can be oriented normal to an imaginary line between the pivot joint 88 and the trunk latch (not shown). This would maintain the position of the trunk latch and striker during flushness adjustments. However, as discussed above, this is a generally less desirable orientation for the slots 52, 53 since it will likely cause some undesirable fore-aft movement of the front edge of the deck lid 30 relative to the vehicle body structure 26 during flushness adjustments. Such fore-aft movement during flushness adjustments may prevent the use of net sized mounting holes in the vehicle body structure 26 and hinge boxes 36.

While the adjustable hinge assemblies shown herein have been described as they relate to a deck lid of a vehicle, they can also be employed in other hinging applications that may require an adjustment feature in order to assure that a closure is flush with adjacent vehicle body structure.

Figure 9:
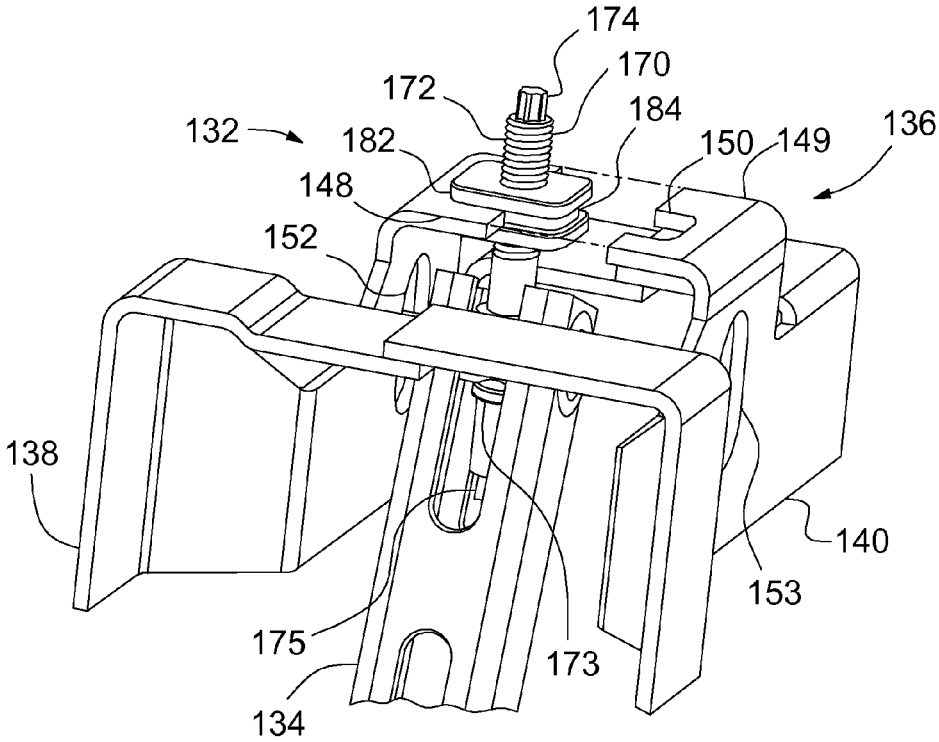
FIG. 9 is a partially exploded, perspective view of a portion of a hinge assembly according to a second embodiment.

FIGS. 9 and 10 illustrate a second embodiment. This embodiment has many items in common with that of the first embodiment, and to avoid unnecessary repetition of the description, the same reference numerals have been used but falling within the 100-series. This hinge assembly 132 still includes the hinge box 136 having a first hinge box bracket 138 that assembles to a second hinge box bracket 140 and mounts to vehicle structure (not shown in this embodiment).

The hinge pin 160 still includes a main body 162 with a central bore 166 extending therethrough, and first and second cylindrical shaft ends 164, 165. As with the first embodiment, shaft ends 164, 165 support the hinge strap 134 via bushings 186 and extend through adjustment slots 152, 153, respectively. Also, an adjustment pin 170 includes a first tool engagement feature 174 adjacent to first adjustment threads 172, which again engage with a retained square nut 182. The nut 182 again includes a groove 184 that is retained within an adjustment pin opening 150 formed by hinge support flanges 148, 149.

The second embodiment differs from the first embodiment in that the adjustment pin 170 does not include threads that engage the central bore 166 of the hinge pin 160. Rather, the adjustment pin 170 is axially retained within the central bore 166 via an integral retention flange 173 and a removable retaining clip 192, while being free to rotate within the central bore 166. Even so, the adjustment pin 170 of this embodiment still includes the second tool engagement feature 175 that is accessible through the access slot 178 in the strap 134. This embodiment, then, retains the features of the first embodiment, with the exception of doubling the axial speed of adjustment when the adjustment pin 170 is rotated via the first or second tool engagement features 174, 175.

FIGS. 11 and 12 illustrate a third embodiment. This embodiment has many items in common with that of the first embodiment, and to avoid unnecessary repetition of the description, the same reference numerals have been used but falling within the 200-series. This hinge assembly 232 still includes the hinge box 236 having a first hinge box bracket 238 that assembles to a second hinge box bracket 240 and mounts to vehicle structure (not shown in this embodiment).

The hinge pin 260 still includes a main body 262 with a central bore 266 extending therethrough, and first and second cylindrical shaft ends 264, 265. As with the first embodiment, shaft ends 264, 265 support the hinge strap 234 via bushings 286 and extend through adjustment slots (only 252 shown). Also, an adjustment pin 270 includes first adjustment threads 272, which again engage with a retained nut 282, and second adjustment threads 273 that are threaded into the central bore 266. The retained nut 282 includes a groove 284 that is retained within an adjustment pin opening 250 formed by the hinge support flanges 248, 249.

The third embodiment differs from the first embodiment in that the adjustment pin 270 does not include a second tool engagement feature. In addition, the first tool engagement feature 274 is now on the nut 282 rather than the adjustment pin 270, with the nut 282 being able to rotate within pin opening 250, even though axially it is still trapped. During the assembly process, after the hinge pin 260 is assembled into the hinge strap 234 and the second adjustment threads 273 are engaged within the central bore 266 at a desired location, the adjustment pin 270 is secured to the hinge pin 260 so no translation or rotation between the two can take place. Accordingly, during a flushness adjustment process, the second adjustment threads 173 do not move relative to the hinge pin 260.

The flushness adjustment process is accomplished by engaging a tool (not shown) with the first tool engagement feature 274 on the retained nut 282, and rotating the nut 282 relative to the adjustment pin 270. This will cause the nut 282 to ride up or down the first adjustment threads 272, thereby adjusting the height of the hinge pin 260, which ultimately affects the height of the deck lid (not shown in this embodiment). Since the groove 284 of the nut 282 is retained in the adjustment pin opening 250 of the hinge box 236, there will be positive displacement for both the upward and downward movement of the hinge pin 260.

While certain embodiments of the present invention have been described in detail, those familiar with the art to which this invention relates will recognize various alternative designs and embodiments for practicing the invention as defined by the following claims.

What is claimed is:

1. A hinge assembly for use with a vehicle deck lid to allow the vehicle deck lid to move between an open position and a closed position relative to a vehicle trunk opening and adjust a flushness of the deck lid relative to an adjacent body structure, the hinge assembly comprising:

a hinge box mountable to vehicle structure adjacent to the vehicle trunk opening and having a first side defining a first adjustment slot extending in a longitudinal direction and a second side, spaced from the first side, defining a second adjustment slot extending in the longitudinal direction, and an adjustment pin support;

a hinge pin having a body defining a central bore extending therethrough, a first shaft end extending from the body through the first adjustment slot and an opposed second shaft end extending from the body through the second adjustment slot, the first and second shaft ends axially slidable in the longitudinal direction in the respective first and second adjustment slots; and an adjustment pin extending through the central bore and axially supporting the hinge pin, the adjustment pin including first adjustment threads that threadably engage and are rotatable relative to the adjustment pin support and support the adjustment pin relative to the hinge box, the adjustment pin having a first end adjacent to the adjustment pin support and an opposed second end adjacent to the central bore of the hinge pin, the second end includes a tool engagement feature that is configured to be engageable by a tool from within a trunk to cause the adjustment pin to rotate relative to the central bore and threadably rotate relative to the adjustment pin support.

2. The hinge assembly of claim 1 including a hinge strap pivotally mounted on the hinge pin and pivotable between the open position and the closed position.

3. The hinge assembly of claim 1 wherein the first end of the adjustment pin includes another tool engagement feature that is configured to be engageable by a tool from outside the trunk to cause the adjustment pin to rotate relative to the central bore and threadably rotate relative to the adjustment pin support.

4. The hinge assembly of claim 3 wherein the adjustment pin includes an integral retention flange adjacent to a first end of the central bore and a removable retaining clip adjacent to a second end of the central bore to thereby axially retain the adjustment pin in the hinge pin while allowing for free rotation of the adjustment pin within the central bore.

5. The hinge assembly of claim 1 wherein the adjustment pin includes an integral retention flange adjacent to a first end of the central bore and a removable retaining clip adjacent to a second end of the central bore to thereby axially retain the adjustment pin in the hinge pin while allowing for free rotation of the adjustment pin within the central bore.

6. The hinge assembly of claim 1 wherein the adjustment pin support includes hinge support flanges and a retained nut axially and rotatably fixed relative to the hinge support flanges, the retained nut including a threaded bore extending therethrough that is threadably engaged with the first adjustment threads.

7. The hinge assembly of claim 1 wherein the longitudinal direction of the first and second adjustment slots is normal to the vehicle deck lid adjacent to the hinge assembly.

8. A hinge assembly for use with a vehicle deck lid to allow the vehicle deck lid to move between an open position and a closed position relative to a vehicle trunk opening and adjust a flushness of the deck lid relative to an adjacent body structure, the hinge assembly comprising:

a hinge box mountable to vehicle structure adjacent to the vehicle trunk opening and having a first side defining a first adjustment slot extending in a longitudinal direction and a second side, spaced from the first side, defining a second adjustment slot extending in the longitudinal direction, and an adjustment pin support including a threaded bore therethrough;

a hinge pin having a body defining a central bore extending therethrough, a first shaft end extending from the body through the first adjustment slot and an opposed second shaft end extending from the body through the second adjustment slot, the first and second shaft ends axially slidable in the longitudinal direction in the respective first and second adjustment slots; and an adjustment pin extending through the central bore and axially supporting the hinge pin, the adjustment pin having a first end adjacent to the adjustment pin support and an opposed second end adjacent to the central bore of the hinge pin, the adjustment pin including first adjustment threads adjacent to the first end that threadably engage and are rotatable relative to the threaded bore and a first tool engagement feature adjacent to the first end that is configured to be engageable by a tool from outside a trunk to cause the adjustment pin to rotate relative to the central bore and threadably rotate relative to the threaded bore, and the adjustment pin including a second tool engagement feature adjacent to the second end that is configured to be engageable by a tool from within the trunk to cause the adjustment pin to rotate relative to the central bore and threadably rotate relative to the threaded bore.

9. The hinge assembly of claim 8 including a hinge strap pivotally mounted on the hinge pin and pivotable between the open position and the closed position.

10. The hinge assembly of claim 8 wherein the adjustment pin includes an integral retention flange adjacent to a first end of the central bore and a removable retaining clip adjacent to a second end of the central bore to thereby axially retain the adjustment pin in the hinge pin while allowing for free rotation of the adjustment pin within the central bore.

11. The hinge assembly of claim 8 wherein the adjustment pin support includes hinge support flanges and a retained nut axially and rotatably fixed relative to the hinge support flanges, the retained nut including the threaded bore extending therethrough that is threadably engaged with the first adjustment threads.

12. The hinge assembly of claim 8 wherein the longitudinal direction of the first and second adjustment slots is normal to the vehicle deck lid adjacent to the hinge assembly.

* * * * *